US007341031B2

(12) United States Patent
Ikihara

(10) Patent No.: US 7,341,031 B2
(45) Date of Patent: Mar. 11, 2008

(54) VALVE TIMING CONTROLLER

(75) Inventor: Tadao Ikihara, Okazaki (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/729,832

(22) Filed: Mar. 30, 2007

(65) Prior Publication Data

US 2007/0240656 A1 Oct. 18, 2007

(30) Foreign Application Priority Data

Apr. 17, 2006 (JP) ..... 2006-113488

(51) Int. Cl.
*F01L 1/34* (2006.01)

(52) U.S. Cl. ..... 123/90.17; 123/90.16; 123/90.27; 123/90.31

(58) Field of Classification Search ..... 123/90.17
See application file for complete search history.

(56) References Cited

U.S. PATENT DOCUMENTS 7,066,122 B2 * 6/2006 Ikihara et al. ..... 123/90.17

* cited by examiner

*Primary Examiner*—Thomas Denion
*Assistant Examiner*—Kyle M. Riddle
(74) *Attorney, Agent, or Firm*—Nixon & Vanderhye P.C.

(57) ABSTRACT

A valve timing controller includes a housing which is biasedly assembled in such a manner that the housing is previously moved in a direction where a rotor knocks the housing. A camshaft rotatably extends through a through-hole provided in a sprocket and is engaged with a camshaft-inserting hole provided in the rotor. An inner diameter of the camshaft-inserting hole is lager than an inner diameter of the through-hole provided in the sprocket in order to prevent the camshaft-inserting hole from overlapping the through-hole.

2 Claims, 4 Drawing Sheets

VALVE TIMING CONTROLLER

CROSS REFERENCE TO RELATED APPLICATION

This application is based on Japanese Patent Application No. 2006-113488 filed on Apr. 17, 2006, the disclosure of which is incorporated herein by reference.

FIELD OF THE INVENTION

The present invention relates to a valve timing controller which adjusts valve timing of an intake vale and/or an exhaust valve of an internal combustion engine.

BACKGROUND OF THE INVENTION

A valve timing controller includes a sprocket which receives a driving force from the engine and a housing which is fixed to the sprocket by a bolt.

FIG. 4 is a longitudinal cross sectional view showing a conventional valve timing controller. FIG. 5 is a cross sectional view taken along a line V-V in FIG. 4. A housing 23 defines a plurality of pressure chambers 20 therein. A rotor 24 is accommodated in the housing 23. A camshaft 28 is connected to the rotor 24 by a bolt 29. The rotor 24 divides each of the pressure chambers 20 into an advance chamber 20*a* and a retard chamber 20*b*. Operational fluid (oil) is introduced into one of chambers 20*a*, 20*b*. The rotor 24 relatively rotates with respect to the housing 23 to vary the rotational phase between the housing 23 and the camshaft 23, whereby the valve timing of the intake valve and/or the exhaust valve is adjusted. The rotor 24 is provided with a stopper pin 26 which can be engaged with a receiving hole 27 provided on the sprocket 22 so that the rotational phase between the housing 23 and the camshaft 28 is held.

A bolt fixes the housing 23 and the sprocket 22 together by its axial force. The valve timing controller is operated by use of hydraulic pressure. The axial force is determined based on the operating hydraulic pressure. However, practically, there is a possibility that air is introduced into the operational fluid, whereby the rotor 24 may knock the housing 23. When the rotor 24 knocks the housing 23, a relative position between the housing 23 and the sprocket 22 may be deviated from the original position.

As shown in FIG. 5, when the rotor 24 knocks a wall surface of the pressure chamber 20 of the housing 23, a force F0 is applied to the housing 23. The housing 23 is slid so that an outer periphery 23*a* of the housing 23 is brought in contact with an inner periphery 22*a* of the sprocket at a point "A".

In order to overcome such a problem, the housing 23 can be clearance-fitted to the sprocket so that the housing 23 cannot be slid more than a predetermined value. However, even in such a structure, the housing 23 slides slightly. Thus, an engaging depth of the stopper pin 26 becomes larger, so that the stopper pin 26 cannot be disengaged with the receiving hole 27 easily.

If the housing 23 and the sprocket 22 are assembled in a state where the housing 23 is slid in the knock direction, the housing 23 does not slide any more. Hence it can be avoided that the stopper pin 26 is hardly disengaged with the receiving hole 27 easily.

A rotational force of the rotor 24 can be utilized to slide the housing 23 toward the point "A". As shown in FIG. 5, the rotor 24 is rotated with the stopper pin 26 engaged with the receiving hole 27 so that the housing 23 slides toward the point "A". At this moment, the rotor 24 moves toward the point "A" with the housing 23

As shown in FIG. 6, in the conventional controller, an inner diameter ϕdl of a camshaft-inserting hole 24*a* of the rotor 24 is smaller than an inner diameter ϕds of a through-hole 22*d* of the sprocket 22. When the housing 23 is slid toward the point "A", the camshaft-inserting hole 24*a* overlaps the through-hole 22*d*. In assembling the controller, the camshaft 28 is hooked on an edge (portion "B" in FIG. 6) of the camshaft-inserting hole 24*a*. Hence, the camshaft 28 cannot be inserted into the camshaft-inserting hole 24*a* enough.

SUMMARY OF THE INVENTION

It is an object of the present invention to easily assemble a sprocket, a rotor, and a camshaft in a valve timing controller. The valve timing controller includes a housing which is biasedly assembled in such a manner that the housing is previously moved in a direction where the rotor knocks the housing. The camshaft rotatably extends through a through-hole provided in the sprocket and is engaged with a camshaft-inserting hole provided in the rotor. An inner diameter of the camshaft-inserting hole is lager than an inner diameter of the through-hole provided in the sprocket in order to prevent the camshaft-inserting hole from overlapping the through-hole. In the present invention, the overlapping of the holes means a case in which the center of each hole deviates from each other and an outer periphery of one hole is encompassed by an outer periphery of the other hole. Although the center of each hole deviates from each other, if the outer periphery of the hole is not encompassed by the outer periphery of the other hole, it is not the overlapping of the holes.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION OF EMBODIMENTS

Figure 1A:
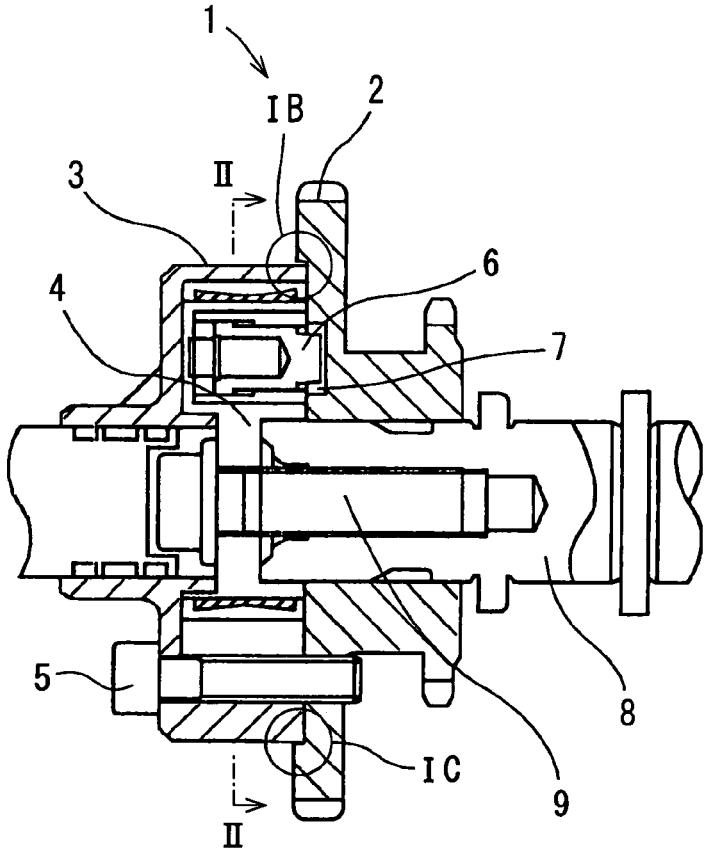
FIG. 1A is a longitudinal cross sectional view showing a valve timing controller according to an embodiment of the present invention.
Figure 1B:
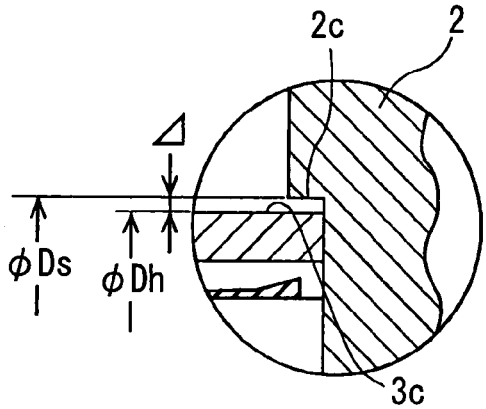
FIG. 1B is an enlarged view of a portion IB in FIG. 1A.
Figure 1C:
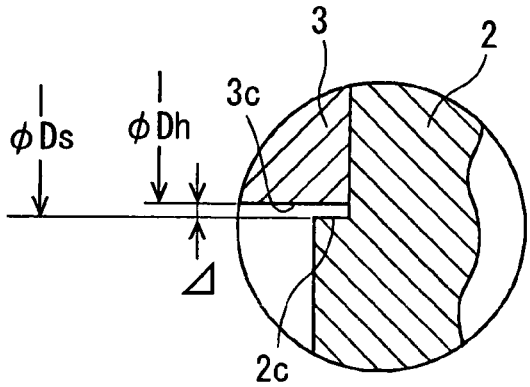
FIG. 1C is an enlarged view of a portion IC in FIG. 1A.
Figure 2:
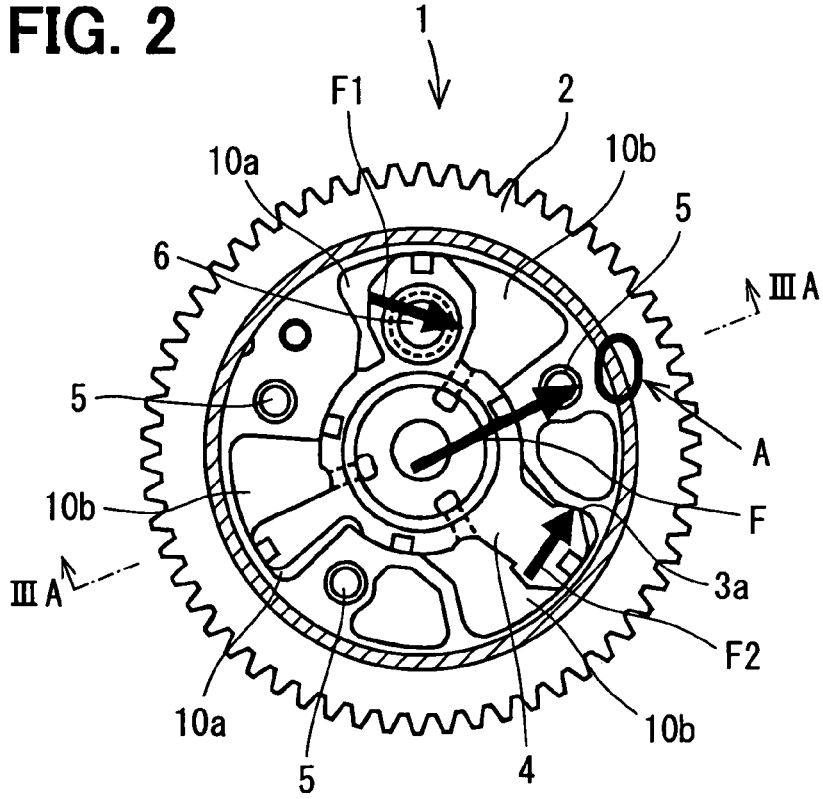
FIG. 2 is a cross sectional view taken along a line II-II in FIG. 1.
Figure 4:
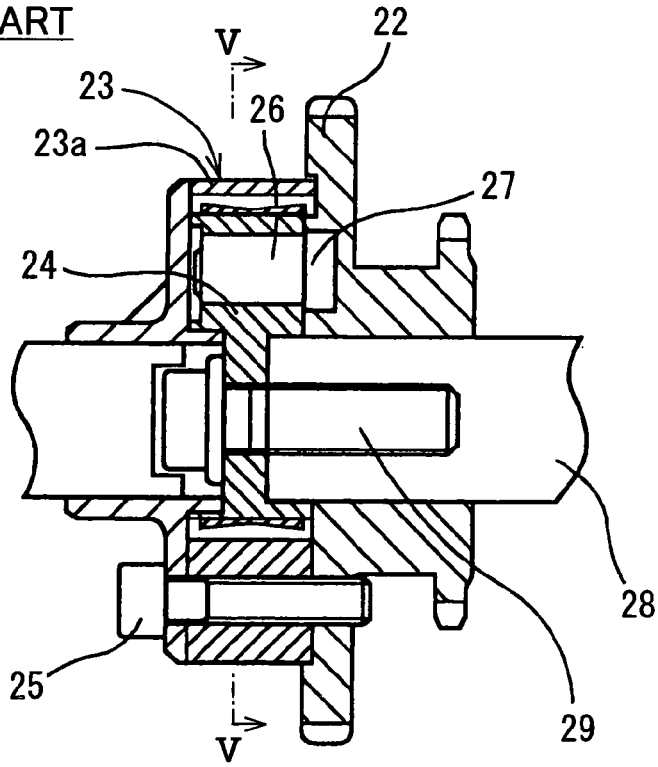
FIG. 4 PRIOR ART
FIG. 4 is a cross sectional view showing a conventional valve timing controller.

Referring to FIGS. 1 to 3, an embodiment of the present invention will be described hereinafter.

FIG. 1A is a longitudinal cross-sectional view showing a valve timing controller 1, FIG. 1B is an enlarged view of a portion IB in FIG. 1A, and FIG. 1C is an enlarged view of a portion IC in FIG. 1A. FIG. 2 is a cross sectional view taken along a line II-II in FIG. 1.

In the valve timing controller 1, a housing 3 is clearance-fitted and connected to a sprocket 3 by a bolt 5. The sprocket 3 receives a driving force from an engine (not shown). As shown in FIGS. 1A and 1B, an outer diameter of an outer peripheral 3*c* of the housing 3 is denoted by $\phi Dh$, and an inner diameter of a housing-receiving portion 2*b* of the sprocket 2 is denoted by $\phi Ds$. A difference between $\phi Dh$ and $\phi Ds$ is defined as $2\times\Delta(\phi Ds-\phi Dh=2\times\Delta)$. The housing 3 is provided with a plurality of pressure chambers 10. Each of the pressure chambers is divided into an advance chamber 10*a* and a retard chamber 10*b* by a rotor 4. Each pressure chamber 10 receives hydraulic pressure through an oil passage (not shown) to vary a rotational phase between the rotor 4 and the housing 3.

The rotor 4 is provided with a stopper pin 6. When the rotor 4 is positioned at a most retarded position, the stopper pin 6 is engaged with a receiving hole 7 provided on the sprocket 2 in order to hold the rotational phase between the rotor 4 and the housing 3. An engagement and a disengagement of the stopper pin 6 are conducted by hydraulic pressure or a spring (not shown).

In assembling the housing 3 to the sprocket 2, the housing 3 is radially shifted to be in contact with the sprocket 2 in a direction that the rotor 4 knocks the housing 3. Then, the rotor 4 is rotated to the most retarded position and the stopper pin 6 is engaged with the receiving hole 7, as shown in FIG. 2. In this state, hydraulic pressure is rapidly introduced into the retard chamber 10*b*, whereby a force F1 is applied to the housing 3 by the hydraulic pressure in the retard chamber 10*b* and the rotor 4 is brought into contact with a wall surface 3*a* of the pressure chamber 10 by a force F2. A resultant force F of the forces F1 and F2 moves the housing 3 toward a point "A". The movement of the housing 3 is restricted by an inner surface 2*c* of the housing-receiving portion 2*b*. As shown in FIGS. 1B and 1C, the maximum moving amount of the housing 3 is defined as $\Delta$.

Figure 3A:
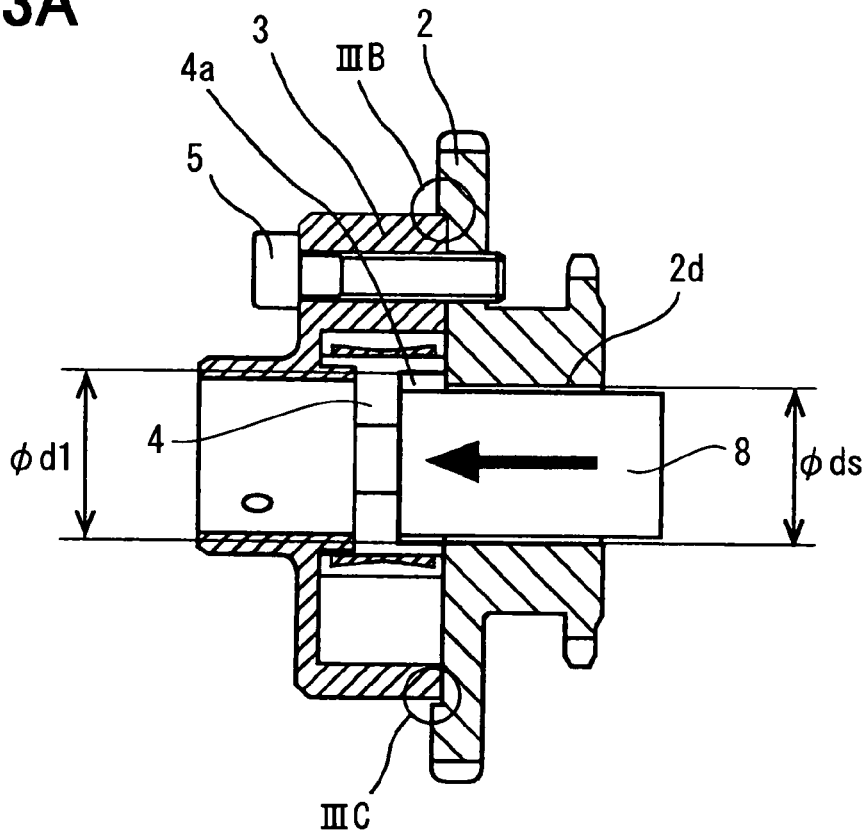
FIG. 3A is a cross sectional view taken along a line III-III in FIG. 2.
Figure 3B:
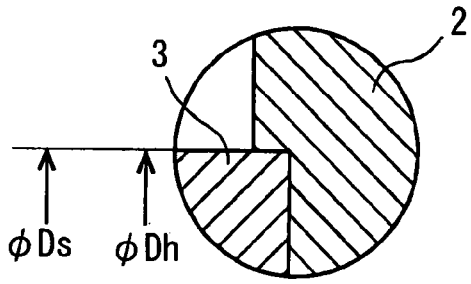
FIG. 3B is an enlarged view of a portion IIIB in FIG. 3A.
Figure 3C:
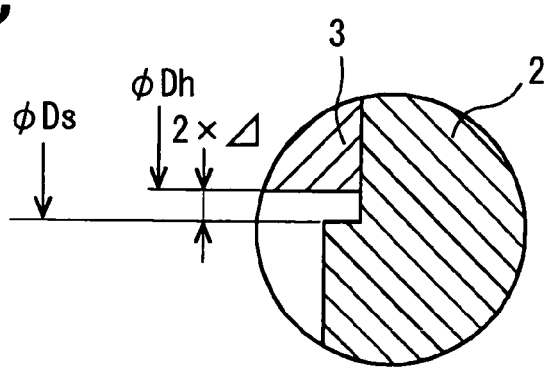
FIG. 3C is an enlarged view of a portion IIIC in FIG. 3A.
Figure 5:
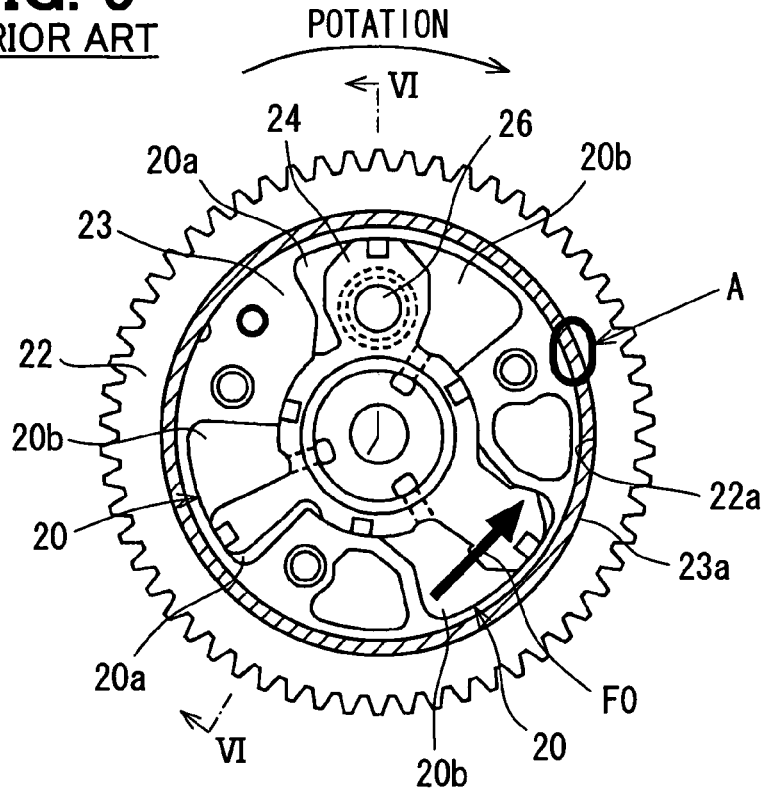
FIG. 5 PRIOR ART
FIG. 5 is a cross sectional view showing taken along a line V-V in FIG. 4.
Figure 6:
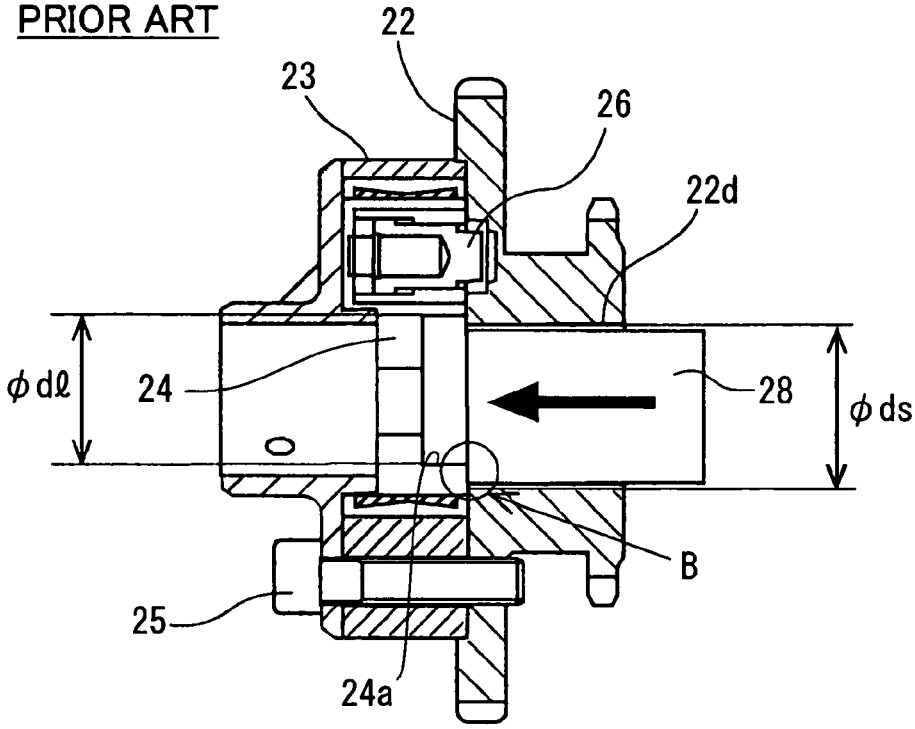
FIG. 6 PRIOR ART
FIG. 6 is a cross sectional view taken along a line VI-VI in FIG. 5.

FIG. 3A is a cross sectional view taken along a line III-III in FIG. 2, which shows that the housing 3 is shifted to be contact with the inner surface 2*c* of the housing-receiving portion at the point "A". FIG. 3B is an enlarged view of a portion IIIB in FIG. 3A, and FIG. 3C is an enlarged view of a portion IIIC in FIG. 3A. An inner diameter $\phi dl$ of a camshaft-inserting hole 4*a* is larger than an inner diameter $\phi ds$ of a through-hole 2*d* by $2\times\Delta$ or more ($\phi dl \geqq \phi ds+2\times\Delta$), so that the camshaft-inserting hole 4*a* does not overlap the through-hole 2*d*. Therefore, the camshaft 8 can be smoothly inserted into the camshaft-receiving hole 4*a* through the through-hole 2*d* to be connected with the rotor 4 by the bolt 9.

What is claimed is:

1. A valve timing controller for an internal combustion engine, comprising:

a sprocket coupled to a driving shaft of the internal combustion engine;

a camshaft receiving a driving force from the sprocket for opening/closing a valve of the internal combustion engine;

a housing connected to the sprocket and having an annular outer peripheral portion which is able to rotate relatively with respect to the camshaft, the housing defining a pressure chamber therein;

a rotor accommodated in the housing and connected to the camshaft, the rotor dividing the pressure chamber into an advance chamber and a retard chamber, the rotor rotating in the housing in response to a pressure in the advance chamber and the retard chamber, a stopper pin provided in the rotor; and a receiving hole provided in the sprocket for engaging with the stopper pin when a rotational phase between the camshaft and the housing is a predetermined phase, wherein the housing is biasedly assembled to the sprocket in a direction in which the rotor knocks the housing, a camshaft rotatably extends through a through-hole provided in the sprocket and is engaged with a camshaft-inserting hole provided in the rotor, and an inner diameter of the camshaft-inserting hole is lager than an inner diameter of the through-hole provided in the sprocket in order to prevent the camshaft-inserting hole from overlapping the through-hole.

2. A valve timing controller according to claim 1, wherein the housing is clearance-fitted to the sprocket, and the inner diameter of camshaft-inserting hole, which is denoted by $\phi dl$, and the inner diameter of through-hole, which is denoted by $\phi ds$, have a relationship expressed by a following equation:

$$\phi dl \geqq \phi ds+2\times\Delta$$

wherein $2\times\Delta$is a difference value between an inner diameter of a housing-receiving portion of the sprocket and an outer diameter of the annular outer peripheral portion.

* * * * *